US005150968A

United States Patent [19]

Inoue

[11] Patent Number: 5,150,968

[45] Date of Patent: Sep. 29, 1992

[54] PLANETARY MIXER

[75] Inventor: Masakazu Inoue, Isehara, Japan

[73] Assignee: Inoue Seisakusho (Mfg) Co., Ltd., Japan

[21] Appl. No.: 657,421

[22] Filed: Feb. 19, 1991

[51] Int. Cl.[5] ..... B01F 7/14

[52] U.S. Cl. ..... 366/288; 366/286

[58] Field of Search ..... 366/279, 285, 286, 287, 366/288, 292, 297, 301, 96-100, 342-344

[56] References Cited

U.S. PATENT DOCUMENTS

| | | | |
|---|---|---|---|
| 374,706 | 12/1887 | Rosenkranz | 366/288 |
| 3,151,847 | 10/1964 | Broomall | 366/287 |
| 4,079,917 | 3/1978 | Popeil | 366/288 |
| 4,697,929 | 10/1987 | Muller | 366/97 |
| 5,028,141 | 7/1991 | Stiegelmann | 366/288 |

FOREIGN PATENT DOCUMENTS

| | | | |
|---|---|---|---|
| 2218538 | 8/1973 | Fed. Rep. of Germany | 366/288 |

*Primary Examiner*—Philip R. Coe
*Assistant Examiner*—Randall Edward Chin
*Attorney, Agent, or Firm*—Bruce L. Adams; Van C. Wilks

[57] ABSTRACT

A planetary mixer having blades which conduct a planetary motion within a tank. A head vertically movably provided above the tank has a drive shaft extending downwardly. The drive shaft has a rotary body, which is provided with three driven shafts at positions corresponding to the respective apexes of an equilateral triangle. The blade is provided at the leading end of each driven shaft. When the rotary body is rotated by the drive shaft, a planetary gearing causes the three blades to rotate on the respective axes of the driven shafts and to simultaneously revolve them around the drive shaft, so that they conduct the planetary motion.

15 Claims, 5 Drawing Sheets

PLANETARY MIXER

BACKGROUND OF THE INVENTION

1. Firld of the Invention

The present invention relates to a planetary mixer for kneading materials to be processed, for instance, by means of blades which undergo a plantary motion.

2. Background Information

A planetary mixer of the sort known in the art is such that two blades undergo a planetary motion within a tank. In the case of such a conventional mixer with the two blades disposed symmetrically, loads acting on the respective blades differ from each other while materials are being processed in the tank, thus acting as a variable load on an agitating shaft. As a result, the load, adversely affects the operation in the form of vibration and the like. When highly viscous materials are processed, moreover, the materials may collect together columnarly, which may in turn prevent a sufficient shearing force from being inparted to the materials When the two blades are caused to undergo planetary motion, a dead space may be produced between the blades in the central part of the tank, the dead space having on effect on giving the blade a motion. An insufficient shearing force is therefore provided for the materials.

Although there is a known planetary mixer whose agitating shaft is set eccentric from the center of its tank, a variable load also acts on the agitating shaft in this case, thus causing troubles.

SUMMARY OF THE INVENTION

An object of the present invention is to provide a planetary mixer designed to make the blades do equal work simultaneously to suppress the generation of a variable load and which is capable of uniformly mixing and agitating materials without allowing them to columnarly collect together.

Another object of the present invention is to provide a planetary mixer capable of eliminating a dead space in a tank while the blades are moving and which is capable of dispersing and kneading materials efficiently by applying a shearing force to the materials between the blades and the inner wall of the tank and also between the blades in the central part of the tank.

The foregoing objects of the present invention can be accomplished by providing a planetary mixer, having three driven shafts secured to a rotary body fixed to a drive shaft, the driven shafts being disposed at equal intervals around the drive shaft, wherein the driven shafts are caused to undergo a plantary motion by means of a planetary gear, and wherein blades are provided at the trailing ends of the respective driven shafts in such a way that the blades rotate in close proximity to the inner wall of the tank.

Further, the objects of the present invention can be accomplished by providing a plantary mixer having three driven shafts which undergo plantary motion and which are disposed at equal intervals in the direction of their orbital motion, wherein the breadth of the blades fitted to the driven shafts is arranged so that the ends of the blades overlap each other, and wherein the ends thereof are formed so as to revolve in close proximity to the inner wall of the tank.

Still further, the objects of the present invention can be accomplished by providing a plantary mixer having a pillar-post provided at the center of the tank, and having three blades which undergo plantary motion in close promixity to the pillar-post.

These and other objects, features and advantages of the invention will become more apparent with reference to the accompanying drawings in which:

DESCRIPTION OF THE PREFERRED EMBODIMENTS

Figure 1:
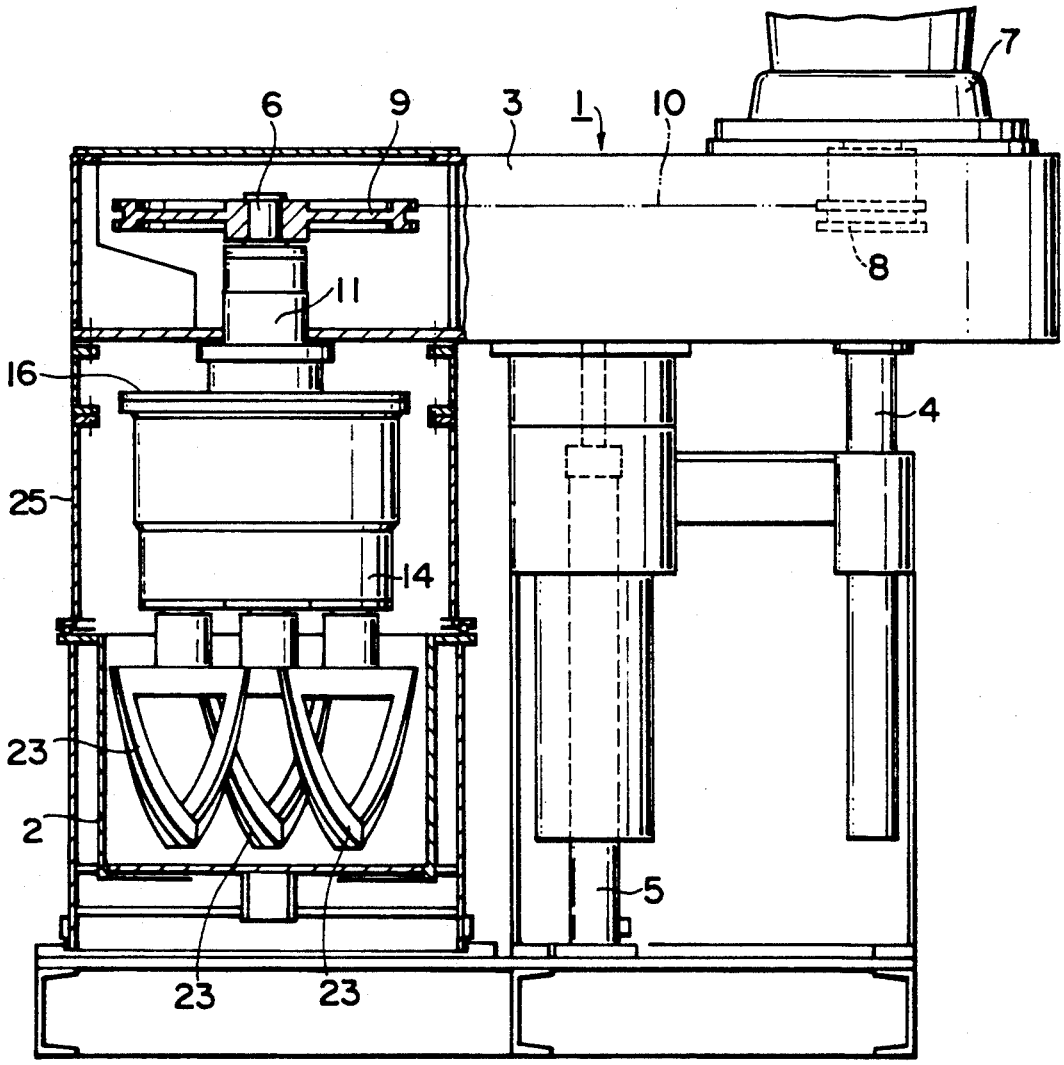
FIG. 1 is an elevational view of a plantary mixer embodying the present invention, illustrating a cover and a tank in section.

Referring first to FIG. 1 as an elevational view of a planetary mixer according to the present invention, a body 1 accommmodates a detachable tank 2 and an agitating head 3 disposed over the tank. The head 3 is guided by a guide rod 4 and vertically moved by a hydraulic cylinder 5. The head 3 may vertically be moved by two hydraulic cylinders provided in the form of a gate. The head 3 is also fitted with a motor 7 for rotating a drive shaft 6. The transmission mechanism between the motor and the drive shaft 6 may be arranged in various ways, an example of which is, as shown in FIG. 1, to use a chain 10 for connecting a drive sprocket 8 formed on the motor shaft with a driven sprocket 9 on the drive shaft 6.

Figure 2:
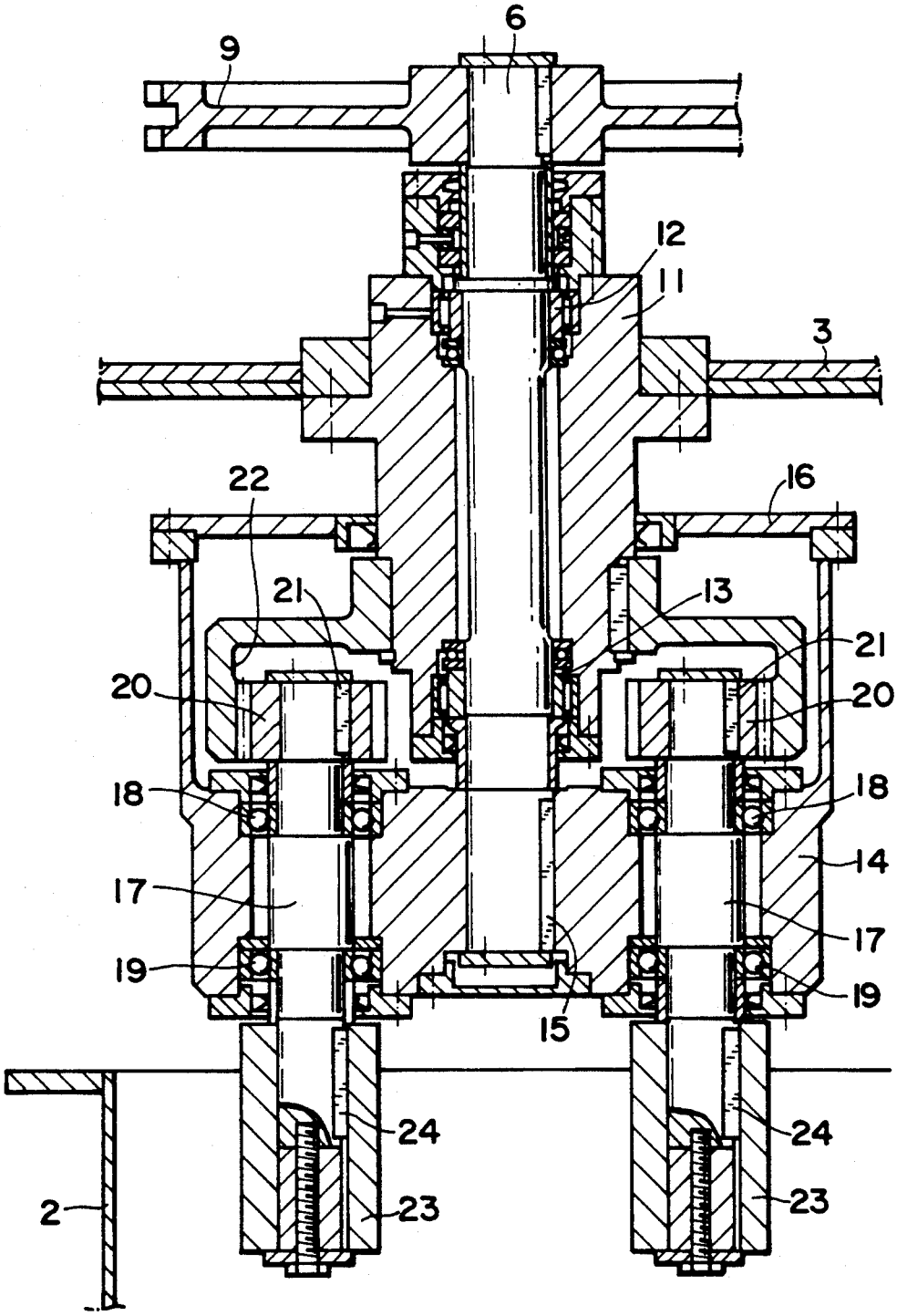
FIG. 2 is an enlarged sectional view of the drive shaft portion of the planetary mixer shown in FIG. 1.
Figure 3:
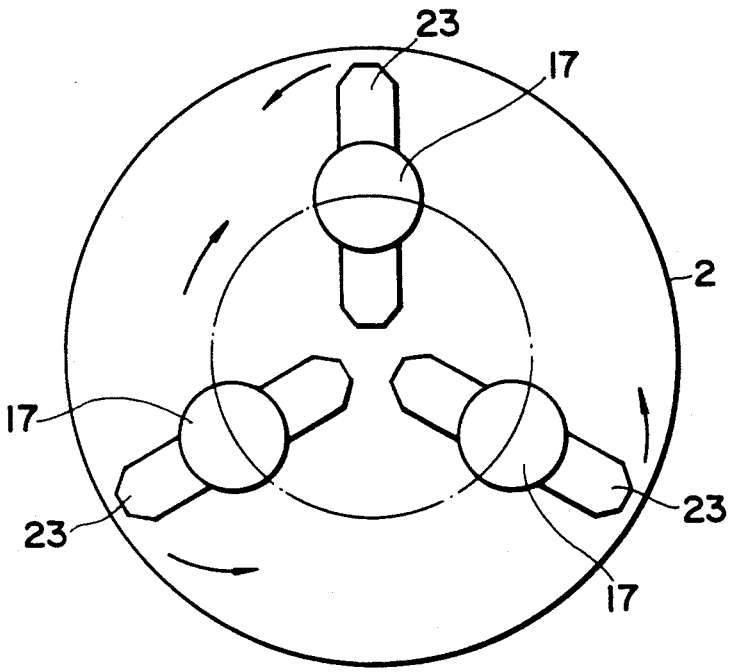
FIG. 3 is diagram illustrating the relation between the blades and the tank.

As shown in FIG. 2, the drive shaft 6 extends through a support cylinder 11 fixed to the head 3, the upper and lower portions being rotatably supported by bearings 12, 13, respectively. A rotary body 14 is fixed with a key 15 at the trailing end of the drive shaft 6. The peripheral edge of the rotary body 14, which is cylindrical in configuration, is extended upward and screwed in a rotatable cover plate 16 that is put on the support cylinder 11. Three driven shafts 17, 17, 17 are rotatably carried by to the rotary body 14 in such a way as to surround the drive shaft 6. In terms of a plan as shown in FIG. 3, 17 the driven shafts 17 are disposed so that they are positioned at respective apexes of an imaginary equilateral triangle. The driven shafts 17 are rotatably supported by bearings 18, 19, respectively. A planetary gear 20 is fixed with a key 21 to the leading end of each driven shaft 17 and engaged with a ring shaped sun gear 22 supported by the support cylinder 11. Although an internal sun gear 22 secured to the support cylinder 11 in such a way as to surround the planetary gear is employed as the sun gear in FIG. 2, such a sun gear may be placed, if desired, in the center of the planetary gear in the leading portion of the support cylinder 11.

A blade 23 is fixed with a key 24 to the trailing end of each driven shaft 17 to make the blades 23 move in close proximity to the inner wall of the tank. The blades may be of the frame-type or of any other construction. The blades 23 shown in FIG. 1 are formed by 90-degree twisting of the lower side of a square frame piece, so that materials are forced down against the bottom of the tank 2.

The outer periphery of the rotary body 14 is enclosed with a cover 25.

When materials are put into the tank 2 with the head 3 lowered, each blade 23 rotates on the axis of the driven shaft 17 and simultaneously revolves around the drive shaft, i.e., the blades 23 undergo a planetary motion. With the use of the stationary internal sun gear 22 as shown in FIG. 2, the direction revolution of the blades 23 is rendered opposite to that of rotation of the blades 23. As the blades 23 conduct the planetary motion in close proximity to the inner wall of the tank 2, a strong shearing force is applied to the materials between the blades and the wall of the tank and between the blades. As a result, the materials can satisfactorily be dispersed, agitated, kneaded and the like. Since the three blades operate likewise, the three driven shafts bear an equal load and this makes it possible to use the mixer without the worry of causing a variable load. In addition, the materials are prevented from columnarly collecting together.

Figure 4:
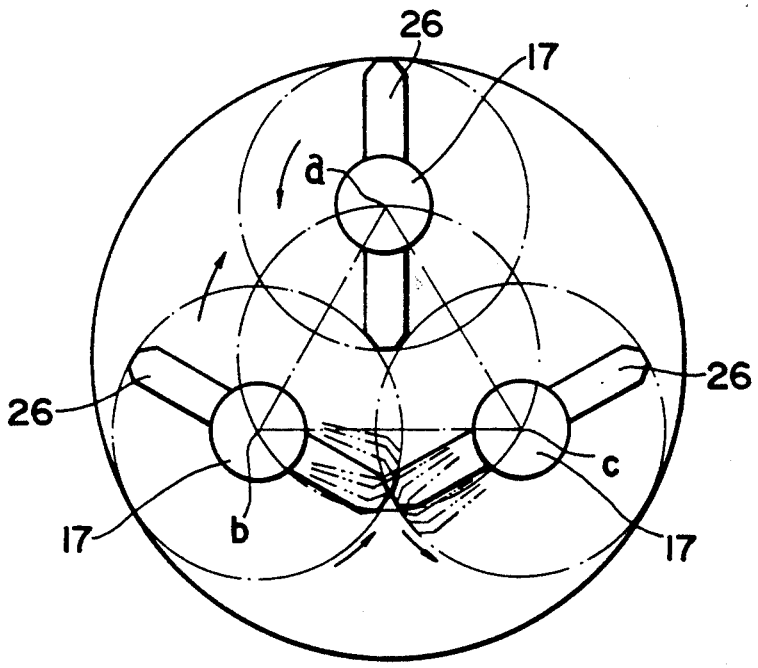
FIG. 4 is a diagram of another embodiment of blades embodying the present invention, illustrating the relation between the blades and the tank.

FIG. 4 illustrates another embodiment of the present invention. As shown in FIG. 4, the widthwise extent or breadth of the blades is arranged so that the ends of the blades overlap each other when the blades conduct the planetary motion. In other words, the breadth (the distance between the opposite radial ends of the blade is made longer than the distance between the axes (ab), (bc), (ac) of the driven shafts 17. Moreover, the radius (covering the length from the axis of the blades shaft up to the end edge thereof) of a blade 26 rotating in close proximity to the inner wall of the tank is set slightly shorter than the distance from the shaft position (a), (b), (c) up to the inner wall of the tank. While the end of one blade 26 is directed to the center as shown in FIG. 4, the ends of the remaining two blades 26, 26 are arranged at a position close to the intersection of their rotary loci, whereby these latter two blades are caused to overlap each other within the range of intersection of their rotary loci, when they are turned in the direction of the arrows.

In this arrangement, as the blades conduct the planetary motion in close proximity to the inner wall of the tank together with their end edges overlapped, a strong shearing force is applied to the materials between the blade and the inner wall of the tank and between the blades. As a result, the materials can satisfactorily be dispersed, agitated, kneaded and the like. Since the three blades overlappingly conduct a motion, moreover, a dead space is practically prevented from being produced in the tank. Therefore, the materials are efficiently processed and prevented from columnarly collecting together.

FIGS. 5 to 8 illustrate other embodiments of the present invention. These embodiments differ in construction from those described above by provision of a center pillar-post (27) formed in order for the blades to move in close proximity to a dead space which is liable to occur at the center of the tank when the blades undergo the planetary motion. Thus, the same portions are indicated with the same numerals. The thickness and the shape of the pillar-post 27 are determined to provide a sufficient shearing force for the materials between the blades in conformity with their size and configuration, the pillar-post being columnar, conical or the like. Although the pillar-post 27 shown in the drawings is a solid rod, it may be hollow so as to let a temperature-adjusting medium such as cooling water pass therethrough.

Figure 5:
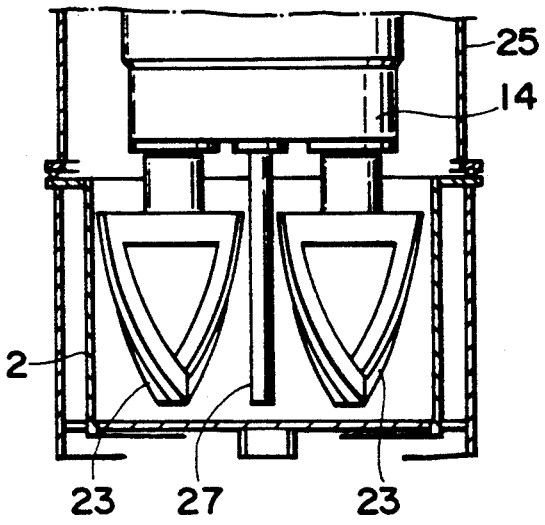
FIG. 5 is an elevational view of another planetary mixer embodying the present invention, illustrating a tank and a cover in section.
Figure 6:
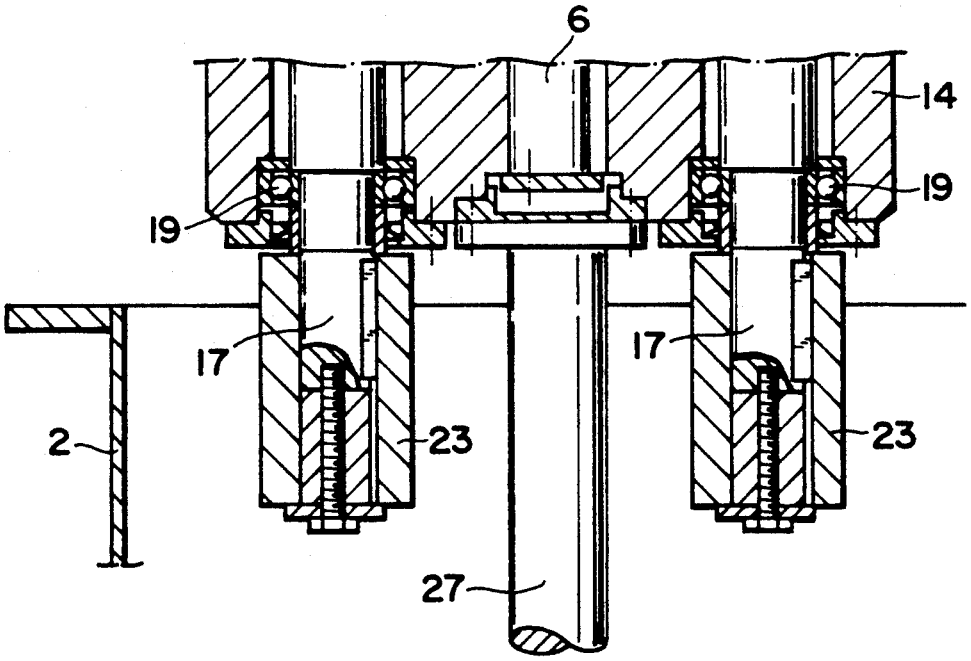
FIG. 6 is an enlarged sectional view of part of the drive shaft position of the planetary mixer shown in FIG. 5.
Figure 7:
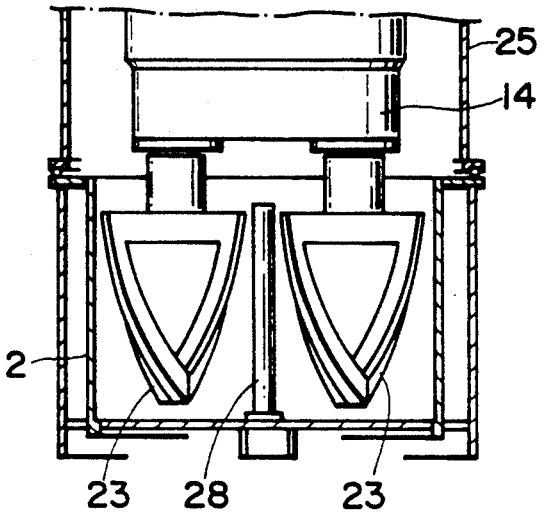
FIG. 7 is an elevational view of still another planetary mixer embodying the present invention, illustrating a tank and a cover in section.
Figure 8:
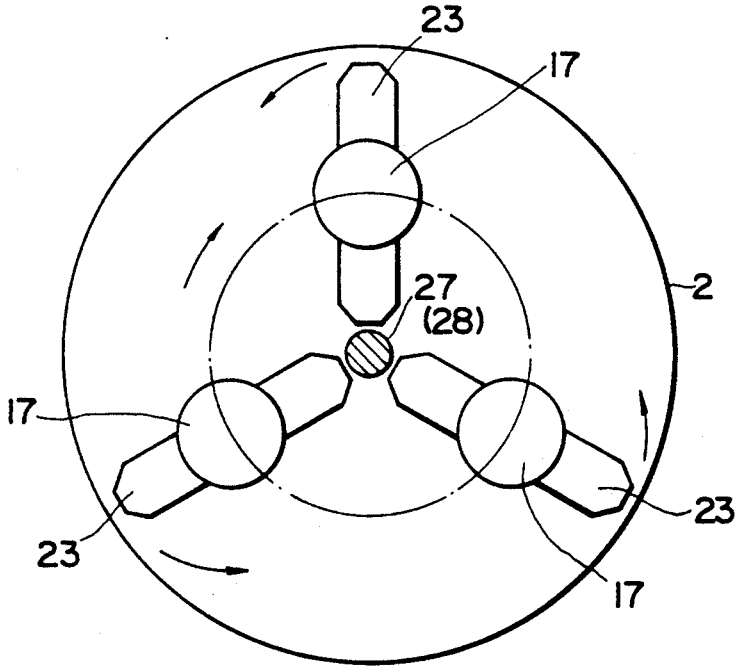
FIG. 8 is a diagram illustrating the relation between the blades and the tank in the embodiments shown in FIGS. 5 and 7.

The pillar-post 27 shown in FIGS. 5 and 6 is secured to the bottom of the rotary body 14 and made to rotate together therewith. On the other hand, a pillar-post 28 shown in FIG. 7 is erected uprightly at the center of the tank 2 and remains unrotatable. When the blades are in operation, they undergo planetary motion in close proximity to the inner wall on the outer periphery of the tank and in close proximity to the pillar-post 27, on the inner periphery thereof. Consequently, the shearing force is applied to the materials to be processed in both the vicinities, whereby they are satisfactorily dispersed, agitated, kneaded and the like.

What is claimed is:

1. A planetary mixer comprising:

an agitating head located above a tank;

a rotationally driven drive shaft downwardly extending from said head;

a rotary body connected to said drive shaft to rotate therewith;

three driven shafts rotatably carried by said rotary body and located at positions corresponding to respective apexes of an imaginary equilateral triangle surrounding said drive shaft;

three agitating blades connected to respective ones of said driven shafts and extending widthwise thereof, each blade having a maximum widthwise extent longer than the distance between the apexes of the imaginary equilateral triangle and long enough to allow said blade to rotate in close proximity to the inner wall of said tank; and means responsive to rotation of said rotary body for rotating said driven shafts on their respective axes and revolving said driven shafts around said drive shaft thereby causing said three blades to undergo planetary motion in close proximity to the inner wall of said tank.

2. A planetary mixer according to claim 1; wherein said means for rotating comprises a planetary gear connected to each driven shaft, and a stationary sun gear in meshing engagement with said planetary gears to effect rotation of said planetary gears accompanied by rotation of said driven shafts in response to rotation of said rotary body.

3. A planetary mixer according to claim 2; wherein said sun gear is disposed within said rotary body.

4. A planetary mixer according to claim 2; wherein said agitating blades each comprise a frame-type blade.

5. A planetary mixer according to claim 4; wherein each frame-type blade comprises a frame member having an upper side connected to its respective driven shaft and a lower side twisted 90° about a vertical axis relative to said upper side.

6. A planetary mixer according to claim 1; wherein said agitating blades each comprise a frame-type blade.

7. A planetary mixer according to claim 6; wherein each frame-type blade comprises a frame member having an upper side connected to its respective driven shaft and a lower side twisted 90° about a vertical axis relative to said upper side.

8. A planetary mixer according to claim 1; including means mounting said head to undergo vertical movement relative to said tank; and driving means for vertically driving said head.

9. A planetary mixer according to claim 8; wherein said driving means comprises a hydraulic cylinder.

10. A planetary mixer according to claim 8; wherein said mounting means includes a vertically extending guide rod for guiding the vertical movement of said head.

11. A planetary mixer according to claim 1; wherein said rotary body has three axially extending through-holes each receiving therein one of said driven shafts, and a pair of axially spaced-apart bearings mounted in each through-hole for rotatably supporting said driven shafts on said rotary body.

12. A planetary mixer according to claim 11; wherein the upper ends of said driven shafts extend upwardly of said through-holes; and said means for rotating comprises a planetary gear connected to the upper end of each driven shaft, and a stationary internal ring gear in meshing engagement with said planetary gears to effect rotation of said planetary gears in response to rotation of said rotary body.

13. A planetary mixer according to claim 12; including means including a driven sprocket connected to said drive shaft for rotationally driving said drive shaft.

14. A planetary mixer according to claim 13; including a stationary support cylinder connected to and extending upwardly of said ring gear, said drive shaft extending through said support cylinder and being rotatably supported thereby.

15. A planetary mixer according to claim 12; including a stationary support cylinder connected to and extending upwardly of said ring gear, said drive shaft extending through said support cylinder and being rotatably supported thereby.

* * * * *